US007413188B2

(12) United States Patent
Miki

(10) Patent No.: US 7,413,188 B2
(45) Date of Patent: Aug. 19, 2008

(54) PAPER FEED CASSETTE, RECORDING MEDIUM SIZE DETECTOR AND IMAGE FORMATION DEVICE USING COAXIAL MOVABLE MEMBERS FOR MOVING ORTHOGONAL FENCES

(75) Inventor: Katsuhiko Miki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 420 days.

(21) Appl. No.: 11/069,953

(22) Filed: Mar. 3, 2005

(65) Prior Publication Data

US 2005/0196211 A1 Sep. 8, 2005

(30) Foreign Application Priority Data

Mar. 5, 2004 (JP) ..... 2004-061915
Oct. 29, 2004 (JP) ..... 2004-315640

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS 3,427,239 A * 2/1969 Abt et al. ..... 204/284
4,563,080 A * 1/1986 Ottley ..... 399/247
5,172,903 A * 12/1992 Haneda et al. ..... 271/171
5,327,206 A * 7/1994 Ueda et al. ..... 399/402
5,634,634 A * 6/1997 Dobbertin et al. ..... 271/3.02
5,647,585 A * 7/1997 Cheong ..... 271/171
6,014,229 A * 1/2000 Yun ..... 358/449
6,073,925 A * 6/2000 Sato ..... 271/171
6,254,085 B1 * 7/2001 Kang ..... 271/171
6,523,822 B1 * 2/2003 Galtier et al. ..... 271/171

(Continued)

FOREIGN PATENT DOCUMENTS

EP 0 285 454 A2 10/1988

(Continued)

OTHER PUBLICATIONS

U.S. Appl. No. 11/475,077, filed Jun. 27, 2006, Miki et al.

*Primary Examiner*—Patrick Mackey
*Assistant Examiner*—Gerald W McClain
(74) *Attorney, Agent, or Firm*—Oblon, Spivak, McClelland, Maier & Neustadt, P.C.

(57) ABSTRACT

A paper feed cassette capable of detecting the size of the recording medium loaded on the paper feed cassette, and an image formation device comprising this recording medium size detector. Side fences and an end fence are slidably provided to a cassette body detachably installed in the body case, and a first movable member which moves in synchronization with the sliding motion of the side fences, and a second movable member which moves in synchronization with the sliding motion of the end fence are provided to the cassette body in an overlapping state. A plurality of synthesized convex portions are formed by overlapping a plurality of first convex portions formed on the first movable member and a plurality of second convex portions formed on the second movable member, and, by sliding the side fences and the end fence in accordance with the size of the recording medium loaded on the cassette body, the width size and position of the synthesized convex portions change in accordance with the size of the recording medium loaded on the cassette body.

14 Claims, 7 Drawing Sheets

U.S. PATENT DOCUMENTS

| | | | | |
|---|---|---|---|---|
| 6,543,761 | B2 * | 4/2003 | Endo | 271/110 |
| 6,557,757 | B1 * | 5/2003 | Peebles | 235/379 |
| 6,688,592 | B1 * | 2/2004 | Tan et al. | 271/171 |
| 7,144,007 | B2 * | 12/2006 | Kim | 271/171 |
| 2005/0196211 | A1 * | 9/2005 | Miki | 399/389 |
| 2006/0087072 | A1 * | 4/2006 | Kwon et al. | 271/171 |

FOREIGN PATENT DOCUMENTS

| | | | |
|---|---|---|---|
| JP | 59227630 A | * | 12/1984 |
| JP | 4-292334 | | 10/1992 |
| JP | 6-32489 | | 2/1994 |
| JP | 09325545 | * | 12/1997 |
| JP | 2000-118729 | | 4/2000 |
| JP | 2001-187643 | | 7/2001 |
| JP | 2002-321833 | | 11/2002 |

* cited by examiner

FIG. 7

| PAPER TYPE | ON/OFF WITH FIRST CONVEX PORTION | | | | | ON/OFF WITH SECOND CONVEX PORTION | | | | | ON/OFF WITH SYNTHESIZED CONVEX PORTION | | | | |
|---|---|---|---|---|---|---|---|---|---|---|---|---|---|---|---|
| | 34A | 34B | 34C | 34D | 34E | 34A | 34B | 34C | 34D | 34E | 34A | 34B | 34C | 34D | 34E |
| A3 | 1 | 0 | 0 | 0 | 0 | 1 | 1 | 0 | 0 | 1 | 1 | 1 | 0 | 0 | 1 |
| B4 | 0 | 0 | 0 | 1 | 1 | 1 | 0 | 0 | 1 | 1 | 1 | 0 | 0 | 1 | 1 |
| A4T | 0 | 1 | 0 | 0 | 1 | 0 | 1 | 0 | 0 | 1 | 0 | 1 | 0 | 0 | 1 |
| B5T | 1 | 0 | 1 | 0 | 0 | 0 | 0 | 0 | 0 | 1 | 1 | 0 | 1 | 0 | 1 |
| A4Y | 1 | 0.5 | 0 | 0 | 0 | 0.5 | 1 | 0 | 0 | 0 | 1 | 1 | 0 | 0 | 0 |
| A5T | 1 | 1 | 1 | 0 | 1 | 0.5 | 1 | 0 | 0 | 0 | 1 | 1 | 1 | 0 | 1 |
| B5Y | 0 | 0 | 0 | 1 | 1 | 0 | 0 | 0 | 1 | 1 | 0 | 0 | 0 | 1 | 1 |
| A5Y | 0 | 1 | 0 | 0 | 1 | 0 | 1 | 1 | 0 | 0 | 0 | 1 | 1 | 0 | 1 |

PAPER FEED CASSETTE, RECORDING MEDIUM SIZE DETECTOR AND IMAGE FORMATION DEVICE USING COAXIAL MOVABLE MEMBERS FOR MOVING ORTHOGONAL FENCES

BACKGROUND OF THE INVENTION

1. Field of the Invention

The present invention relates to a paper feed cassette to be used in feeding a recording medium in an image formation device, a recording medium size detector for detecting the size of the recording medium loaded on the paper feed cassette, and an image formation device comprising this recording medium size detector.

2. Description of the Background Art

In image formation devices such as a copy machine or printer, there are types where the paper feed cassette having a recording medium loaded thereon is installed in a body case, the recording medium loaded on a paper feed cassette is fed, and image is formed on such recording medium. This kind of paper feed cassette comprises a side fence abut on the end fence in the width direction orthogonal to the feeding direction of the recording medium loaded on this cassette body, and an end fence abut on the rear end face in the feeding direction of the recording medium loaded on this cassette body, and the loading position of the recording medium is determined by sliding the side fence and end fence and abutting them on the recording medium.

Further, in an image formation device employing a paper feed cassette comprising such a slidable side fence and end fence, there is a type which comprises a mechanism for detecting the size of the recording medium loaded on the paper feed cassette from the slide position of the side fence and end fence (e.g., this is disclosed in the gazettes of Japanese Patent Laid-Open Publication No. 2000-118729 and Japanese Patent Laid-Open Publication No. H6-32489).

In the invention disclosed in foregoing Japanese Patent Laid-Open Publication No. 2000-118729, a measurement piece which slides in synchronization with the movement of the side fence, and a portion to be measured that rotates or slides in synchronization with the movement of the end fence are provided to the paper feed cassette. First and second ranging means positioned so as to face the measuring piece/portion to be measured when the paper feed cassette is installed in the case body are provided to the body case of the image formation device to which the paper feed cassette is installed. As a result of the measuring piece sliding in synchronization with the movement of the side fence, and the portion to be measured rotating or sliding in synchronization with the movement of the end fence, the distance between the measuring piece and first ranging means, and the distance between the measure portion and second ranging means upon installing the paper feed cassette in the body case will change. By detecting these distances with the first and second ranging means, the slide position of the side fence and end fence; that is, the size of the recording medium loaded on the paper feed cassette can be detected.

Further, in the invention disclosed in foregoing Japanese Patent Laid-Open Publication No. H6-32489, a paper sheet size recognition member that rises and falls in synchronization with the movement of a guide member (side fence), and a paper sheet size recognition member that rises and falls in synchronization with the movement of a guide member (end fence) are provided to the paper feed cassette. These paper size recognition members are disposed in mutually adjacent positions in close proximity. A plurality of actuators to be selectively pressed with the protruding paper sheet size recognition members is provided to the body case of the image formation device to which the paper feed cassette is installed. The paper sheet size recognition member rises or falls according to the size of the recording medium loaded on the paper feed cassette, the plurality of actuators is selectively pressed with the paper size recognition members protruding when the paper feed cassette is installed in the body case, and the size of the recording medium loaded on the paper feed cassette is detected depending on which actuator is being pressed.

Further, in the invention disclosed in foregoing Japanese Patent Laid-Open Publication No. 2000-118729, the measuring piece that slides in synchronization with the movement of the side fence and the portion to be measured that rotates or slides in synchronization with the movement of the end fence function independently upon detecting the size of the recording medium. Thus, the ranging means for measuring the distance to the measuring piece and the ranging means for measuring the distance to the portion to be measured must be provided separately.

Further, in the invention disclosed in foregoing Japanese Patent Laid-Open Publication No. H6-32489, the paper sheet size recognition member that rises and falls in synchronization with the movement of a guide member (side fence), and the paper sheet size recognition member that rises and falls in synchronization with the movement of a guide member (end fence) function independently upon detecting the size of the recording medium. Thus, two types of actuators; namely, an actuator for detecting the rising and falling state of the paper sheet size recognition member that rises and falls in synchronization with the movement of the guide member (side fence), and an actuator for detecting the rising and falling state of the paper sheet size recognition member that rises and falls in synchronization with the movement of the guide member (end fence) must be provided.

SUMMARY OF THE INVENTION

Thus, an object of the present invention is to provide a paper feed cassette, a recording medium size detector capable of detecting, with a simple constitution and with high accuracy, the size of the recording medium loaded on the paper feed cassette, and an image formation device comprising this recording medium size detector.

A paper feed cassette of the present invention comprises a cassette body capable of loading a plurality of recording mediums thereon and detachable from a body case; a side fence provided slidably to the cassette body which abuts on the end face in the width direction orthogonal to the feeding direction of the recording medium loaded on this cassette body; an end fence provided slidably to the cassette body which abuts on the rear end face in the feeding direction of the recording medium loaded on this cassette body; a first movable member having formed thereon a plurality of first convex portions at the peripheral edge thereof, which selectively makes the first convex portions face a plurality of portions to be pressed of a size detection switch provided to the body case for detecting the size of the recording medium loaded in said cassette body, and is mounted on the cassette body movably in the direction of varying the portions to be pressed facing the first convex portion in synchronization with the sliding motion of the side fence; and a second movable member having formed thereon a plurality of second convex portions at the peripheral edge thereof, which selectively makes the second convex portions face a plurality of the portions to be pressed, and is mounted on the cassette body movably in the direction of varying the portions to be pressed facing the second convex portion in synchronization with the sliding motion of the end fence. The first movable member and the second movable member are disposed at a position where the first convex portion and the second convex portion are overlapping, a plurality of synthesized convex portions for selectively pressing the portions to be pressed are formed by overlapping the first convex portion and the second convex portion, and the width size and position of these synthesized convex portions vary in synchronization with the sliding motion of the side fence and the end fence according to the size of the recording medium loaded on the cassette body.

A recording medium size detector of the present invention is provided with a paper feed cassette. The paper feed cassette comprises a cassette body capable of loading a plurality of recording mediums thereon and detachable from a body case; a side fence provided slidably to the cassette body which abuts on the end face in the width direction orthogonal to the feeding direction of the recording medium loaded on this cassette body; an end fence provided slidably to the cassette body which abuts on the rear end face in the feeding direction of the recording medium loaded on this cassette body; a first movable member having formed thereon a plurality of first convex portions at the peripheral edge thereof, which selectively makes the first convex portions face a plurality of portions to be pressed of a size detection switch provided to the body case for detecting the size of the recording medium loaded in the cassette body, and is mounted on the cassette body movably in the direction of varying the portions to be pressed facing the first convex portion in synchronization with the sliding motion of the side fence; and a second movable member having formed thereon a plurality of second convex portions at the peripheral edge thereof, which selectively makes the second convex portions face a plurality of the portions to be pressed, and is mounted on the cassette body movably in the direction of varying the portions to be pressed facing the second convex portion in synchronization with the sliding motion of the end fence. The first movable member and the second movable member are disposed at a position where the first convex portion and the second convex portion are overlapping, a plurality of synthesized convex portions for selectively pressing the portions to be pressed are formed by overlapping said first convex portion and the second convex portion, and the width size and position of these synthesized convex portions vary in synchronization with the sliding motion of the side fence and the end fence according to the size of the recording medium loaded on the cassette body; and a size detection switch having a plurality of portions to be pressed which are selectively pressed by the synthesized portions provided to the paper feed cassette installed in the body case.

An image formation device of the present invention is provided with a recording medium size detector which comprises a paper feed cassette. The paper feed cassette comprises a cassette body capable of loading a plurality of recording mediums thereon and detachable from a body case; a side fence provided slidably to the cassette body which abuts on the end face in the width direction orthogonal to the feeding direction of the recording medium loaded on this cassette body; an end fence provided slidably to the cassette body which abuts on the rear end face in the feeding direction of the recording medium loaded on this cassette body; a first movable member having formed thereon a plurality of first convex portions at the peripheral edge thereof, which selectively makes the first convex portions face a plurality of portions to be pressed of a size detection switch provided to the body case for detecting the size of the recording medium loaded in the cassette body, and is mounted on the cassette body movably in the direction of varying the portions to be pressed facing the first convex portion in synchronization with the sliding motion of the side fence; and a second movable member having formed thereon a plurality of second convex portions at the peripheral edge thereof, which selectively makes the second convex portions face a plurality of the portions to be pressed, and is mounted on the cassette body movably in the direction of varying the portions to be pressed facing the second convex portion in synchronization with the sliding motion of the end fence. The first movable member and the second movable member are disposed at a position where the first convex portion and the second convex portion are overlapping, a plurality of synthesized convex portions for selectively pressing the portions to be pressed are formed by overlapping the first convex portion and the second convex portion, and the width size and position of these synthesized convex portions vary in synchronization with the sliding motion of the side fence and the end fence according to the size of the recording medium loaded on the cassette body; and a size detection switch having a plurality of portions to be pressed which are selectively pressed by the synthesized portions provided to the paper feed cassette installed in the body case; a device for separately feeding the recording medium, one by one, from the paper feed cassette installed in the body case; and a printer engine for forming an image in accordance with the image data input to the recording medium separately fed.

BRIEF DESCRIPTION OF THE DRAWINGS

The above and other objects, features and advantages of the present invention will become more apparent from the following detailed description taken with the accompanying drawings in which:

FIG. 7 is an explanatory diagram showing the pressure relationship of the first convex portion, second convex portion and synthesized convex portion and the portion to be pressed of the size detection switch;

DESCRIPTION OF THE PREFERRED EMBODIMENT(S)

An embodiment of the present invention is now explained with reference to the drawings.

Figure 1:
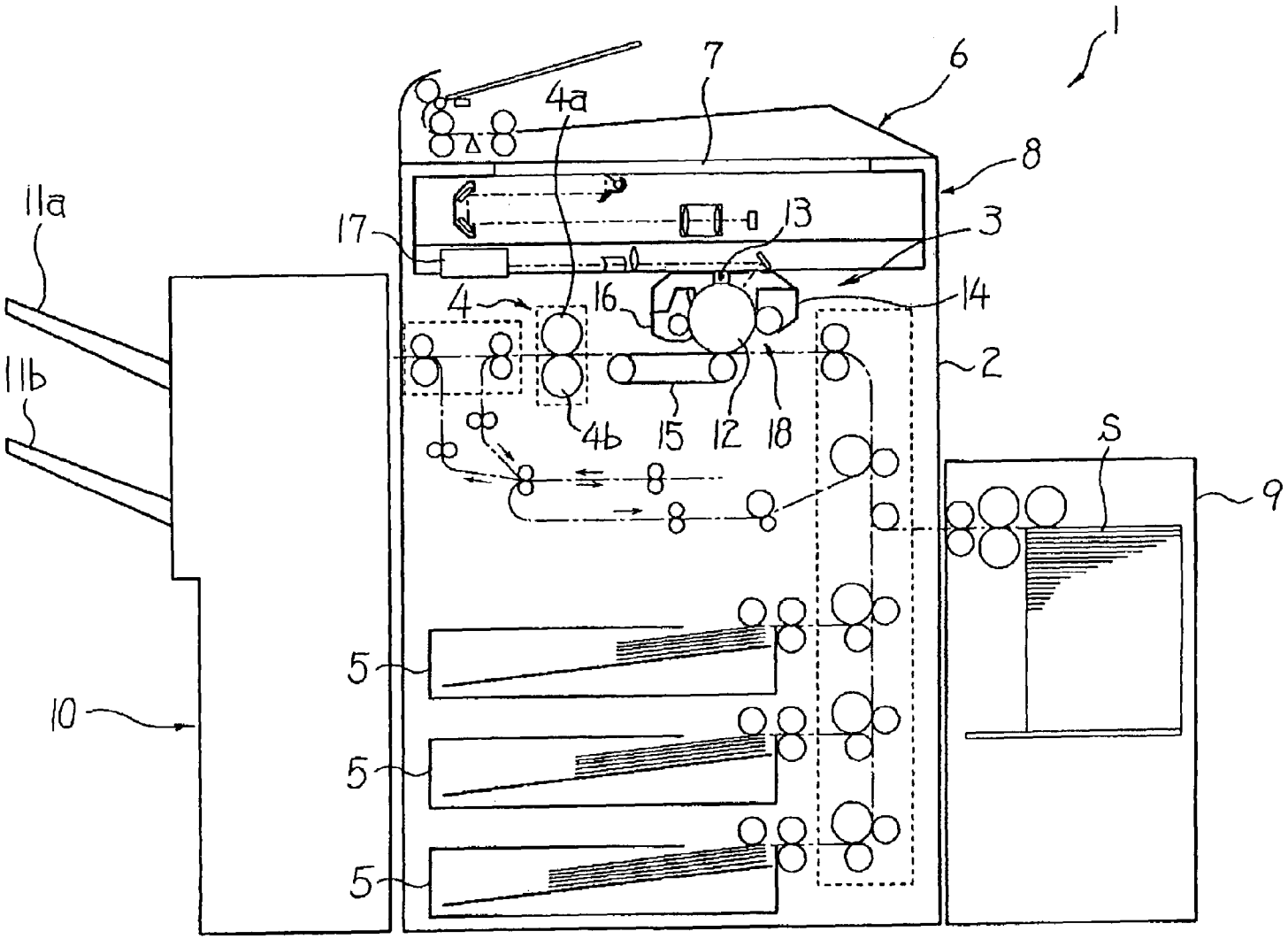
FIG. 1 is a front view showing the schematic configuration inside the copy machine according to an embodiment of the present invention.

FIG. 1 is a front view showing the schematic configuration inside the copy machine 1 according to an embodiment of the present invention.

A printer engine 3 and a fixation device 4 are provided to the upper part inside a body case 2 of the copy machine 1, and a plurality of paper feed cassettes 5 is detachably installed at the lower part inside the body case 2. An ADF 6 for automatically feeding the manuscript, which is the object to be read; a contact glass 7 to which the manuscript as the object to be read is mounted; and an image reading device 8 for reading the manuscript automatically fed with the ADF 6 or mounted on the contact glass 7 are disposed at the upper part of the body case 2. A bulk paper feed device 9 and a sheet post-processing device 10 are disposed on the side of the body case 2. A transport path for transporting the recording medium S fed from the paper feed cassette 5 or the bulk paper feed device 9 to the paper catch tray 11*a*, 11*b* is formed via the printer engine 3 and fixation device 4.

The printer engine 3 is formed from a photo conductor 12, a charging device 13, a development device 14, a transfer/transport device 15, a cleaning device 16, an optical writing device 17, and so on. A part of this printer engine 3 is made to be a process cartridge 18 which houses the photo conductor 12, charging device 13, development device 14 and cleaning device 16 in a cartridge case, in an integrated manner. The process cartridge 18 is detachably installed in the body case 2.

The photo conductor 12 is a cylindrical member that is rotatably driven around the axis, and a conductive support, an under coat layer, a charge generating layer, a charge transport layer and so on are laminated and formed in this order from the inner periphery thereof. The surface of this photo conductor 12 is charged uniformly, and, by exposure being performed according to the image data in relation to the surface of the uniformly charged photo conductor 12, an electrostatic latent image is written.

The charging device 13 uniformly charges the surface of the photo conductor 12. The charging device 13, for instance, may be a corona charger employing the corona discharge system for charging the surface of the photo conductor 12 in a non-contact manner, or may be a contact charge roller that is disposed in contact with the surface of the photo conductor 12, and which charges the surface of the photo conductor 12 by applying a charge voltage between the photo conductors 12.

The optical writing device 17 emits light in accordance with the image data, and exposes and scans the surface of the photo conductor 12 charged uniformly with the charging device 13. As a result of this exposure and scanning, an electrostatic latent image is written on the surface of the photo conductor 12. Although the detailed drawings and explanation thereof are omitted since this is publicly known technology, as one example, this is formed from a light source such as a laser diode for emitting light, a polygon mirror for scanning the light emitted from the light source, a motor for rotating the polygon mirror, a lens or mirror for guiding the light scanned with the polygon mirror to the photo conductor 12, and so on.

The development device 14 comprises a development roller (not shown) for supplying the toner supplied from the toner bottle (not shown) to the surface of the photo conductor 12. As a result of the toner being supplied to the surface of the photo conductor 12, the toner will adhere to the electrostatic latent image written on the surface of the photo conductor 12 creating a microscopy image, and a toner image is formed thereby.

The transfer/transport device 15 applies a transfer voltage between the photo conductors 12 when the recording medium S fed from the paper feed cassette 5 or the bulk paper feed device 9 and transported on the transport path is sandwiched between the transfer/transport device 15 and the photo conductor 12, and transfers the toner image formed on the surface of the photo conductor 12 onto the recording medium S. Further, it transports the recording medium S to which the toner image has been transferred toward the fixation device 4.

The cleaning device 16 collects the toner remaining on the photo conductor 12 that was not transferred onto the recording medium S.

The fixation device 4 has a fixation roller 4*a* having a built-in heater and a pressuring roller 4*b* pressed against this fixation roller 4*a* from below, and applies heat and pressure when the recording medium S to which the toner image has been transferred passes through between the fixation roller 4*a* and pressuring roller 4*b*, dissolves the toner and fixes the toner image onto the recording medium S.

In this kind of constitution, with the copy machine 1, when the manuscript is set in the ADF 6, or when the manuscript is mounted on the contact glass 7, and the start key provided on the operation panel (not shown) is pressed, the image reading device 8 reads the image of the manuscript, and the printer engine 3 begins to form the image thereof according to the read results. In the image formation with this printer engine 3, image data is created based on the read results of the image reading device 8, light is emitted from the optical writing device 17 according to such image data, and the surface of the photo conductor 12 is exposed and scanned pursuant to the emitted light. An electrostatic latent image is formed on the surface of the photo conductor 12 based on the exposure scanning, and this electrostatic latent image is created into a microscopy image as the toner image with the toner supplied from the development device 14.

Meanwhile, when the start key is pressed, the recording medium S of a designated size, or the recording medium S of a size automatically selected according to the manuscript size or the like is separately fed, one by one, with a means for separately feeding such recording medium S from the paper feed cassette S or the bulk paper feed device 9, and is transported on the transport path toward the printer engine 3. The recording medium S transported on the transport path is sent to the toner image transfer position (contact position of the transfer/transport device 15 and photo conductor 12) in accordance with the image formation operation timing in the printer engine 3, and the toner image on the photo conductor 12 is transferred onto the recording medium S. The recording medium S with the toner image transferred thereto is transported to the fixation device 4, and, after being fixed with the fixation device 4, is discharged directly to the paper catch tray 11*a*, or discharged to the paper catch tray 11*b* after being subject to post-processing such as stapling with the sheet post-processing device 10.

Under the foregoing constitution, characteristic portions of the present embodiment are now explained sequentially.

Figure 2:
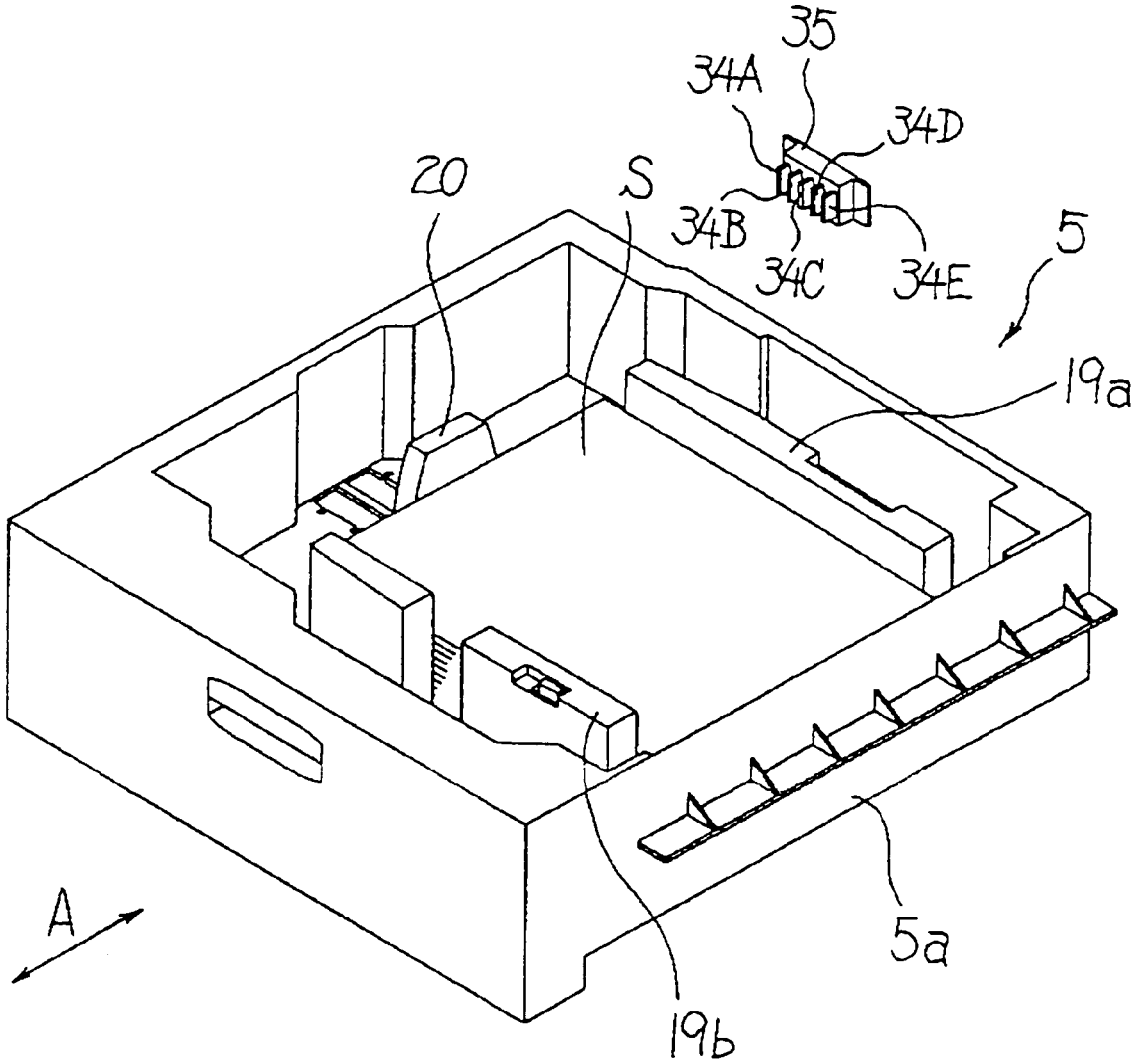
FIG. 2 is a perspective view showing the paper feed cassette and size detection switch of the copy machine.
Figure 3:
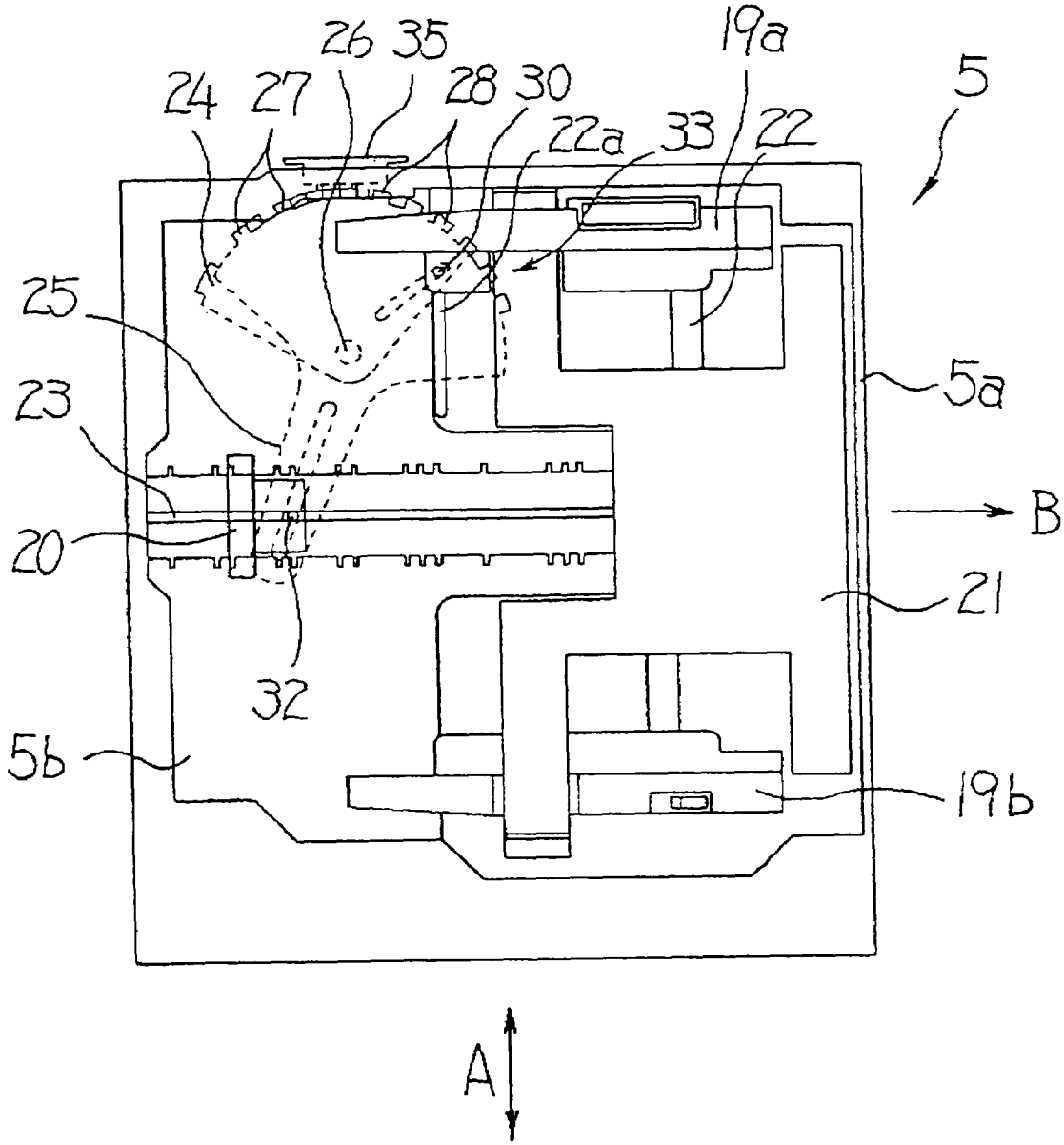
FIG. 3 is a plan view of the paper feed cassette positioned at the mounting point inside the body case of the copy machine, and the size detection switch provided inside the body case.
Figure 4:
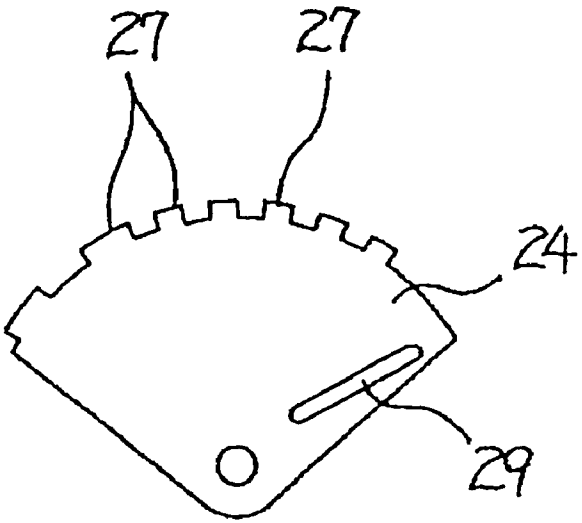
FIG. 4 is a plan view showing the first movable member of the size detection switch.

FIG. 2 is a perspective view showing the paper feed cassette and size detection switch of the copy machine; FIG. 3 is a plan view of the paper feed cassette positioned at the mounting point inside the body case of the copy machine, and the size detection switch provided inside the body case; FIG. 4 is a plan view showing the first movable member mounted on the back side of the recording medium load face of the paper feed cassette; and FIG. 5 is a plan view showing the second movable member mounted on the recording medium load face of the paper feed cassette.

As shown in FIG. 2 and FIG. 3, the paper feed cassette 5 has a box shaped cassette body 5*a* in which the upper end face thereof is opened, and a pair of side fences 19*a*, 19*b* and one end fence 20 are slidably mounted on this cassette body 5*a*. Further, as shown in FIG. 3, a bottom plate 21 for raising the front edge side of the feeding direction of the loaded recording medium S is provided to apart of the cassette body 5*a*, which is also apart of the recording medium load face 5*b* to which the recording medium S is loaded. The direction of arrow A illustrated in FIG. 2 and FIG. 3 is the attaching and detaching direction of the paper feed cassette 5 in relation to the body case 2.

Guide grooves 22, 22*a* extending along the width direction orthogonal to the feeding direction of the recording medium S (direction of arrow B illustrated in FIG. 3) loaded on the recording medium load face 5*b*, and a guide grooves 23 extending along the feeding direction of the recording medium S loaded on the recording medium load face 5*b* are formed on the recording medium load face Sa. The side fences 19*a*, 19*b* are slidably fitted into the guide groove 22, and the side fences 19*a*, 19*b* are capable of abutting on the end face in the width direction orthogonal to the feeding direction of the recording medium S loaded on the recording medium load face 5*b*. The end fence 20 is slidably fitted into the guide groove 23, and the end fence 20 is capable of abutting on the rear end face in the width direction orthogonal to the feeding direction of the recording medium S loaded on the recording medium load face 5*b*. Further, a rack (not shown) disposed on the back side of the recording medium load face 5*b* is connected to the side fences 19*a*, 19*b*, and these racks are connected via a pinion. As a result, the pair of side fences 19*a*, 19*b* has a constitution of sliding the same distance of approaching and separating from each other based on the pinion mechanism.

Figure 5:
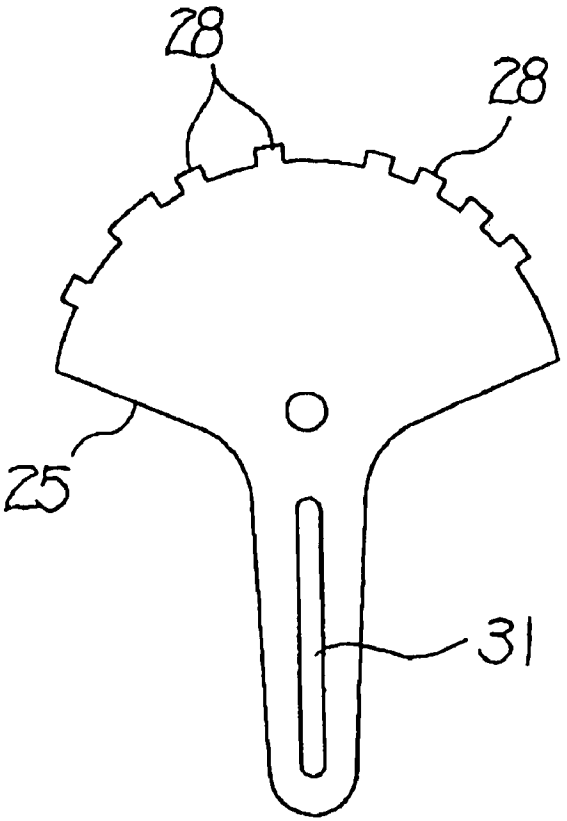
FIG. 5 is a plan view showing the second movable member of the size detection switch.

A first movable member 24 formed in a fan shape as shown in FIG. 4 and a second movable member 25 formed in the shape of a ginkgo biloba as shown in FIG. 5 are overlappingly disposed on the back face of the recording medium load face 5*b*, and these are mounted rotatably around the axis of a common spindle 26. The first movable member 24 and the second movable member 25 are formed from a single tabular member, and are disposed in parallel to the recording medium load face 5*a*. The first movable member 24 and second movable member 25 have an arcuate peripheral edge set the same distance from the axis of the spindle 26, and a plurality of first convex portions 27 is formed on the arcuate peripheral edge of the first movable member 24, and a plurality of second convex portions 28 is formed on the arcuate peripheral edge of the second movable member 25. The first movable member 24 and second movable member 25 are positioned to be within the outside dimension of the case body 5*a*.

A first slide groove 29 extending in the direction intersecting with the guide groove 22*a*; that is, the direction intersecting with the sliding direction of the side fence 19*a*, is formed on the first movable member 24. A pin 30 fixed to the side fence 19*a* and inserted into the guide groove 22*a* is slidably fitted into the first slide groove 29. As a result, when the side fence 19*a* is slid toward the direction orthogonal to the feeding direction of the recording medium S, the pin 30 will slide inside the guide groove 22*a* and the first slide groove 29, and the first movable member 24 will rotate around the axis of the spindle 26.

A second slide groove 31 extending in the direction intersecting with the guide groove 23; that is, the direction intersecting with the sliding direction of the end fence 20, is formed on the second movable member 25. A pin 32 fixed to the end fence 20 and inserted into the guide groove 23 is slidably fitted into the second slide groove 31. As a result, when the end fence 20 is slid toward the direction orthogonal to the feeding direction of the recording medium S, the pin 32 will slide inside the guide groove 23 and the second slide groove 31, and the second movable member 25 will rotate around the axis of the spindle 26.

Here, as a result of the first movable member 24 and the second movable member 25 being overlapped and disposed, the first convex portion 27 of the first movable member 24 and the second convex portion 28 of the second movable member 25 will be positioned in an overlapping manner, and a plurality of synthesized convex portions 33 will be formed by overlapping the first convex portion 27 and second convex portion 28.

When the side fences 19*a*, 19*b* or the end fence 20 are slid in accordance with the side of the recording medium S loaded on the recording medium load face 5*b*, the first movable member 24 will rotate around the axis of the spindle 26 in synchronization with the sliding motion of the side fences 19*a*, 19*b*, and the second movable member 25 will rotate around the axis of the spindle 26 in synchronization with the sliding motion of the end fence 20. As a result of the first movable member 24 and the second movable member 25 rotating around the axis of the spindle 26, the overlapping state of the first convex portion 27 and the second convex portion 28 will change, and the width size and position of the synthesized convex portion 33 will change along the alignment direction of the portion to be pressed provided to the size detection switch described later. In other words, the width size and position of the synthesized convex portion 33 will change in accordance with the size of the recording medium S loaded on the recording medium load face 5*b*.

A size detection switch 35 having a plurality of portions to be pressed 34 (34A, 34B 34C, 34D, 34E) to be selectively pressed with the synthesized convex portion 33 is mounted inside the body case 2 at the front edge of the installation direction of the paper feed cassette 5. FIG. 6 is a diagram showing the pressed state of the portion to be pressed 34 being pressed with the first convex portion 27, second convex portion 28 and synthesized convex portion 33 in a case where the paper feed cassette 5 loaded with the recording medium S of an A4 landscape (A4Y) on the recording medium load face 5*b* is installed in the body case 2.

Figure 6A:
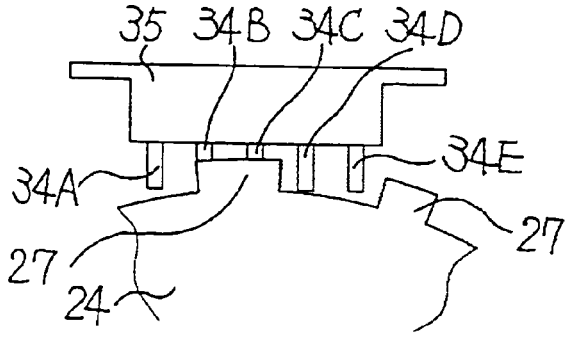
FIG. 6A and FIG. 6B are plan views showing the positional relationship of the first convex portion of the first movable member and the portion to be pressed.
Figure 6B:
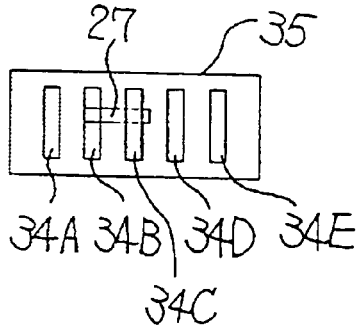

FIG. 6A and FIG. 6B are diagrams showing the positional relationship of the portion to be pressed 34 and the first convex portion 27. Two portions to be pressed 34B, 34C and the first convex portion 27 are facing each other, and the portions to be pressed 34B, 34C being pressed with the first convex portion 27 are turned ON.

Figure 6C:
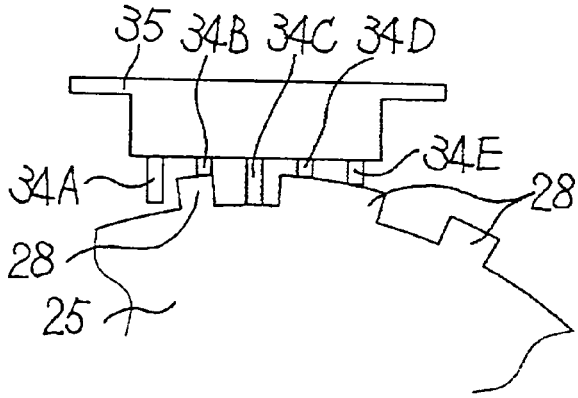
FIG. 6C and FIG. 6D are plan views showing the positional relationship of the second convex portion of the second movable member and the portion to be pressed.
Figure 6D:
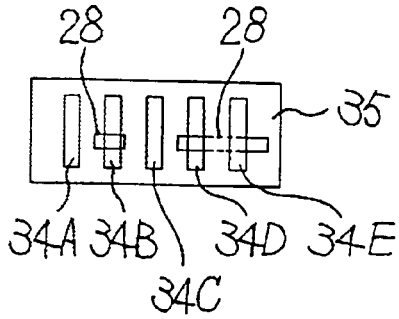

FIG. 6C and FIG. 6D are diagrams showing the positional relationship of the portion to be pressed 34 and the second convex portion 28. Three portions to be pressed 34B, 34D, 34E and the second convex portion 28 are facing each other, and the portions to be pressed 34B, 34D, 34E being pressed with the second convex portion 28 are turned ON.

Figure 6E:
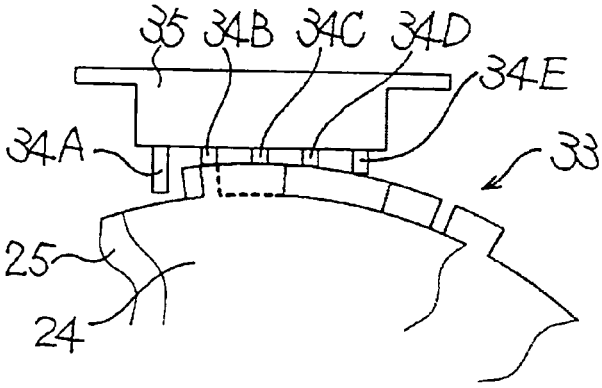
FIG. 6E and FIG. 6F are plan views showing the positional relationship of the synthesized convex portion and the portion to be pressed.
Figure 6F:
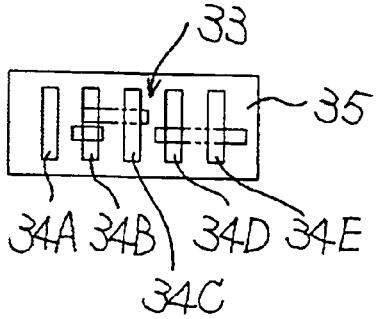

FIG. 6E and FIG. 6F are diagrams showing the positional relationship of the portion to be pressed 34 and the synthesized convex portion 33. Four portions to be pressed 34B, 34C, 34D, 34E and the synthesized convex portion 33 are facing each other, and the portions to be pressed 34B, 34C, 34D, 34E being pressed with the synthesized convex portion 33 are turned ON.

FIG. 7 is an explanatory diagram showing the size (Y is landscape, T is portrait) of the recording medium S loaded on the recording medium load face 5*b*, and pressed state of the portion to be pressed 34 being pressed with the first convex portion 27, second convex portion 28 and synthesized convex portion 33 in such a case. "0" implies that the portion to be pressed 34 is not being pressed and is turned OFF. "1" implies that the portion to be pressed 34 is being pressed and is turned ON. "0.5" implies that there is a variation in the positional relationship of the first convex portion 27, second convex portion 28 and the portion to be pressed 34, and that there is a case where the portion to be pressed 34 is being pressed and a case where the portion to be pressed 34 is not being pressed.

Here, from the perspective of seeking the miniaturization of the copy machine 1, there are cases where the members to be pressed 34 cannot be reliably pressed with the first convex portion 27 or second convex portion 28 independently since the spacing between the portions to be pressed 34 cannot be made large, and the width size of the first convex portion 27 and second convex portion 28 cannot be made large. Thus, when focusing on the pressed state of the portion to be pressed 34B, although this portion to be pressed 34B is being reliably pressed with the synthesized convex portion 33, it is possible that this may not be reliably pressed with the first convex portion 27 or second convex portion 28 independently. For such a case, the second convex portion 28 supplements the pressing operation of the first convex portion 27 to enable the reliable pressing of the portion to be pressed 34B.

Figure 8:
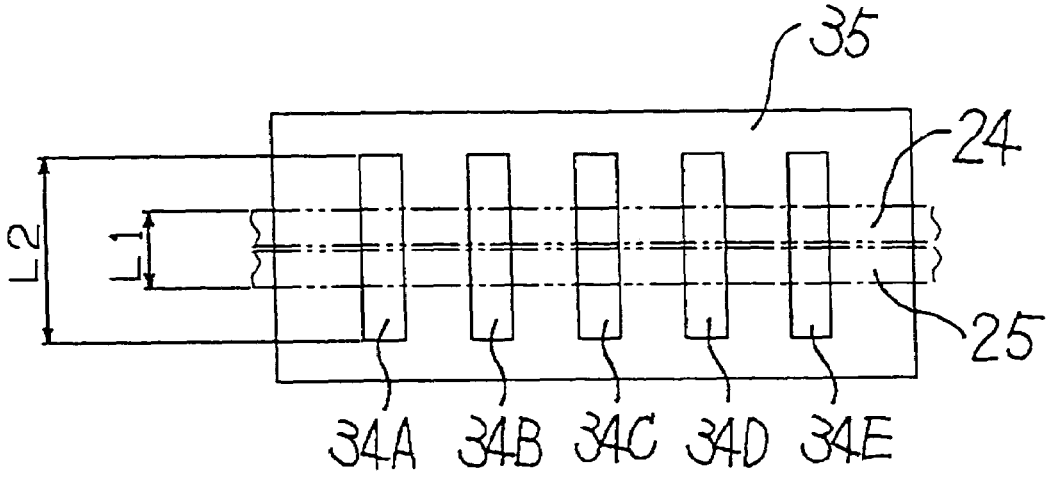
FIG. 8 is a side view showing the relationship of the size of the overlapping direction of the first movable member and second movable member in the synthesized convex portion, and the size in the same direction of this overlapping direction in the portion to be pressed.
Figure 9:
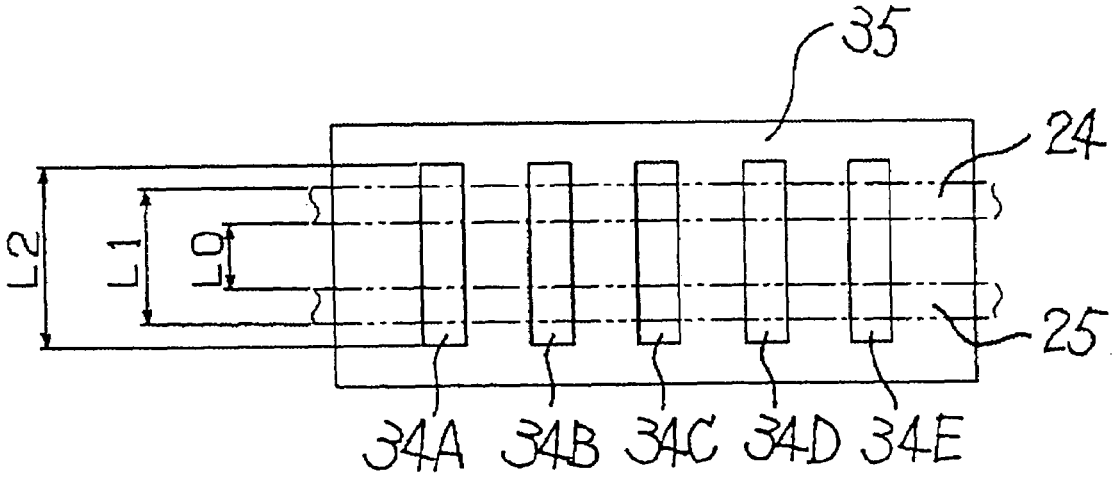
FIG. 9 is a side view showing a modified example of the overlapping state of the first movable member and second movable member.

FIG. 8 is a side view showing the relationship of the width size (vertical width size) of the overlapping direction of the first movable member 24 and second movable member 25 in the synthesized convex portion 33, and the width size in the same direction of this overlapping direction in the portion to be pressed 34. The width size (same as the width size in the overlapping direction of the first movable member 24 and second movable member 25) L1 of the overlapping direction of the first movable member 24 and second movable member 25 in the synthesized convex portion 33 is set to be smaller than the wide size L2 in the same direction of this overlapping direction in the portion to be pressed 34. Thus, when the synthesized convex portion 33 presses the portion to be pressed 34, it is possible to prevent the synthesized convex portion 33 from departing from the pressing area of the portion to be pressed 34, and the synthesized convex portion 33 will therefore be able to reliably press the portion to be pressed 34, and the performance of detecting the size of the recording medium S with the size detection switch 35 can be improved.

Further, a gap size L0 capable of preventing the first movable member 24 and the second movable member 25 from coming into contact may be secured between the first movable member 24 and the second movable member 25 in relation to the disposition of the overlapping direction of the first movable member 24 and the second movable member 25. As a result of securing this gap size L0, the rotation of the first movable member 24 and the rotation of the second movable member 25 can be conducted smoothly without contacting each other.

Moreover, with this copy machine 1, a part of the printer engine 3 is constituted with the process cartridge 18. Thus, as a result of performing high-precision detection of the side of the recording medium S with the synthesized convex portion 33, a malfunction of forming a toner image that is larger than the size of the surface area of the fed recording medium S can be prevented. Accordingly, the wasteful use of toner can be reduced, the cleaning of the toner used wastefully can be reduced, the toner housed in the development device 14 can be kept longer, the time until the cleaning device 16 becomes full will become longer, and the life of the process cartridge 18 can be extended thereby.

Incidentally, although an example of a paper feed cassette 5 comprising a pair of side fences 19*a*, 19*b* and which positions the loaded recording medium S in the center was provided in the present embodiment, the present invention may also be employed in a paper feed cassette comprising only one side fence and which positions the loaded recording medium S on one side.

As described above, the present invention yields the following effects:

(1) When a recording medium of a given size is loaded on the cassette body, and the side fence and end fence are slid according to the size of such recording medium, the first movable member will move in synchronization with the sliding motion of the side fence, the second movable member will move in synchronization with the sliding motion of the end fence, and the a plurality of synthesized convex portions will be formed by the first convex portion formed on the first movable member and the second convex portion formed on the second movable member being overlapped. The width size and position of this synthesized convex portion will change in synchronization with the sliding motion of the side fence and end fence according to the size of the recording medium loaded on the cassette body, and, since the portion to be pressed of the size detection switch to be pressed with the synthesized convex portion will change pursuant to the foregoing change in the synthesized convex portion, the size detection switch will be able to detect the size of the recording medium loaded on the cassette body. Thereby, the size detection switch merely needs to detect the synthesized convex portion in order to detect the size of the recording medium loaded on the cassette body, and, since the target of detection will only be one item; that is, the synthesized convex portion, the size of the recording medium loaded on the cassette body can be detected reliably with a simple structure.

(2) Even when the respective width sizes of the first convex portion and second convex portion will be restricted, since the width size of the synthesized convex portion can be formed larger than the width size when the first convex portion and second convex portion are independent, even if there is a position shift between the portion to be pressed of the size detection sensor and the first convex portion and second convex portion, the influence of the position shift between the portion to be pressed of the size detection sensor and the synthesized convex portion will become small, and the reliability upon detecting the side of the recording medium with the synthesized convex portion can be improved.

(3) Therefore, since the first movable member and the second movable member are tabular members, and are disposed in parallel with the back side of the recording medium load face of the cassette body, the synthesized convex portion can be formed in a small space.

(4) Therefore, as a result of rotating the first movable member and second movable member around the axis of the spindle, the overlapping state of the first convex portion and second convex portion will change according to the size of the recording medium loaded on the cassette body so as to form the synthesized convex portion, and the formation of the synthesized convex portion can be reliably conducted thereby.

(5) Therefore, the structure for rotatably supporting the first movable member and the second movable member can be made simple.

(6) Therefore, when the side fence is slid, the pin provided to the side fence will engage with the first slide groove and slide integrally with the side fence. As a result, the first movable member will rotate around the spindle, and the rotational movement of the first movable member in synchronization with the sliding motion of the side fence can be conducted reliably.

(7) Therefore, when the end fence is slid, the pin provided to the end fence will engage with the second slide groove and slide integrally with the end fence. As a result, the second movable member will rotate around the spindle, and the rotational movement of the second movable member in synchronization with the sliding motion of the end fence can be conducted reliably.

(8) Therefore, the structure of the paper feed cassette can be made simple.

(9) Therefore, the user's hand or the like will not contact the first movable member or the second movable member upon handling the paper feed cassette, and the safety upon handling the paper feed cassette can be improved.

(10) Therefore, when the paper feed cassette is installed in the body case, the plurality of synthesized convex portions in which the width size and position thereof have changed according to the size of the recording medium loaded on the cassette body selectively presses the portion to be pressed of the size detection switch, and the size of the recording medium can be detected with high accuracy based on the pressed results.

(11) Therefore, when the synthesized convex portion presses the portion to be pressed, it is possible to prevent the overlapping direction of the first movable member and the second movable member in the synthesized convex portion from departing from the pressing area of the portion to be pressed, the synthesized convex portion will be able to reliably press the portion to be pressed, and the performance of the size detection switch detecting the size of the recording medium can be improved.

(12) Therefore, since the image formation device comprises the recording means size detector according to claim 11 or claim 12, it is able to form images based on a reliable size detection of the recording medium. Thus, image formation in a size matching the size of the recording medium can be reliably conducted.

(13) Therefore, since images can be formed based on a reliable size detection of the recording medium, it is possible to prevent the formation of a toner image that is larger than the size of the surface area of the recording medium, the wasteful use of toner can be reduced, the cleaning of the toner that was not transferred can be reduced, and the life of the process cartridge can be extended thereby.

Various modifications will become possible for those skilled in the art after receiving the teachings of the present disclosure without departing from the scope thereof.

What is claimed is:

1. A paper feed cassette, comprising:

a cassette body capable of loading a plurality of recording mediums thereon and detachable from a body case;

a side fence provided slidably to said cassette body which abuts on an end face in a width direction orthogonal to a feeding direction of a recording medium loaded on the cassette body;

an end fence provided slidably to said cassette body which abuts on a rear end face in the feeding direction of the recording medium loaded on the cassette body;

a size detection switch provided with the body case, configured to detect a size of the recording medium loaded in the cassette body;

a first movable member having formed thereon a plurality of first convex portions at a peripheral edge thereof, which selectively makes said first convex portions face a plurality of portions to be pressed of the size detection switch, and is mounted on said cassette body and is movable in a direction of said portions to be pressed in synchronization with a sliding motion of said side fence; and a second movable member having formed thereon a plurality of second convex portions at a peripheral edge thereof, which selectively makes said second convex portions face a plurality of said portions to be pressed, and is mounted on said cassette body movably in the direction of varying said portions to be pressed facing said second convex portion in conjunction with the sliding motion of said end fence;

wherein said first movable member and said second movable member are disposed at a position where said first convex portion and said second convex portion are overlapping and an outermost edge of each of the first and second convex portions extends a same distance from a common axis of rotation of the first and second movable members, a plurality of synthesized convex portions are formed by the overlapping of said first convex portion and said second convex portion and selectively press said portions to be pressed, and a width size and position of the synthesized convex portions vary in conjunction with the sliding motion of said side fence and said end fence according to the size of the recording medium loaded on said cassette body.

2. A paper feed cassette as claimed in claim 1, wherein a width size of at least a part of said synthesized convex portions is formed larger than the width size of one of said first convex portion and said second convex portion.

3. A paper feed cassette as claimed in claim 1, wherein said first movable member and said second movable member are tabular members, and the first movable member and second movable member are disposed at a back side of a face of said cassette body on which the recording medium is loaded in parallel with a recording medium load face.

4. A paper feed cassette as claimed in claim 1, wherein said first movable member and said second movable member are provided rotatably around a spindle positioned coaxially, and said first convex portion and said second convex portion are positioned on a same circular arc.

5. A paper feed cassette as claimed in claim 4, wherein said first movable member and said second movable member are provided rotatably around a common spindle.

6. A paper feed cassette as claimed in claim 4, wherein a first slide groove extending in a direction intersecting with a slide direction of said side fence is formed on said first movable member, and a pin provided to said side fence is slidably fitted into said first slide groove.

7. A paper feed cassette as claimed in claim 4, wherein a second slide groove extending in a direction intersecting with a slide direction of said end fence is formed on said second movable member, and a pin provided to said end fence is slidably fitted into said second slide groove.

8. A paper feed cassette as claimed in claim 1, wherein said first movable member is formed from a single member.

9. A paper feed cassette as claimed in claim 1, wherein said second movable member is formed from a single member.

10. A paper feed cassette as claimed in claim 1, wherein said first movable member and said second movable member are positioned within an outside dimension of said cassette body.

11. A recording medium size detector having a paper feed cassette, said paper feed cassette comprising:

a cassette body capable of loading a plurality of recording mediums thereon and detachable from a body case;

a side fence provided slidably to said cassette body which abuts on an end face in a width direction orthogonal to a feeding direction of a recording medium loaded on this cassette body;

an end fence provided slidably to said cassette body which abuts on a rear end face in the feeding direction of the recording medium loaded on the cassette body;

a size detection switch provided with the body case, configured to detect a size of the recording medium loaded in the cassette body;

a first movable member having formed thereon a plurality of first convex portions at a peripheral edge thereof, which selectively makes said first convex portions face a plurality of portions to be pressed of the size detection switch, and is mounted on said cassette body and is movable in a direction of said portions to be pressed in synchronization with a sliding motion of said side fence; and a second movable member having formed thereon a plurality of second convex portions at a peripheral edge thereof, which selectively makes said second convex portions face a plurality of said portions to be pressed, and is mounted on said cassette body movably in the direction of said portions to be pressed in conjunction with the sliding motion of said end fence;

wherein said first movable member and said second movable member are disposed at a position where said first convex portion and said second convex portion are overlapping and an outermost edge of each of the first and second convex portions extends a same distance from a common axis of rotation of the first and second movable members, a plurality of synthesized convex portions are formed by the overlapping of said first convex portion and said second convex portion and selectively press said portions to be pressed, and a width size and position of the synthesized convex portions vary in conjunction with the sliding motion of said side fence and said end fence according to the size of the recording medium loaded on said cassette body; wherein the size detection switch has a plurality of portions to be pressed which are selectively pressed by said synthesized convex portions provided to said paper feed cassette installed in said body case.

12. A recording medium size detector as claimed in claim 11, wherein a size in an overlapping direction of said first movable member and said second movable member in said synthesized convex portion is set to be smaller than the size in the same direction as the overlapping direction in a portion to be pressed.

13. An image formation device having a recording medium size detector which comprises a paper feed cassette, said paper feed cassette comprising:

a cassette body capable of loading a plurality of recording mediums thereon and detachable from a body case;

a side fence provided slidably to said cassette body which abuts on an end face in a width direction orthogonal to a feeding direction of a recording medium loaded on the cassette body;

an end fence provided slidably to said cassette body which abuts on a rear end face in the feeding direction of the recording medium loaded on the cassette body;

a size detection switch provided with the body case, configured to detect a size of the recording medium loaded in the cassette body;

a first movable member having formed thereon a plurality of first convex portions at a peripheral edge thereof, which selectively makes said first convex portions face a plurality of portions to be pressed of the size detection switch, and is mounted on said cassette body and is movable in a direction of said portions to be pressed in synchronization with a sliding motion of said side fence; and a second movable member having formed thereon a plurality of second convex portions at a peripheral edge thereof, which selectively makes said second convex portions face a plurality of said portions to be pressed, and is mounted on said cassette body movably in the direction of varying said portions to be pressed facing said second convex portion in conjunction with the sliding motion of said end fence;

wherein said first movable member and said second movable member are disposed at a position where said first convex portion and said second convex portion are overlapping and an outermost edge of each of the first and second convex portions extends a same distance from a common axis of rotation of the first and second movable members, a plurality of synthesized convex portions are formed by the overlapping of said first convex portion and said second convex portion and selectively press said portions to be pressed, and a width size and position of the synthesized convex portions vary in conjunction with the sliding motion of said side fence and said end fence according to the size of the recording medium loaded on said cassette body; and means for separately feeding the recording medium, one by one, from said paper feed cassette installed in said body case; and a printer engine for forming an image in accordance with the image data input to the recording medium separately fed, wherein the size detection switch has a plurality of portions to be pressed which are selectively pressed by said synthesized portions provided to said paper feed cassette installed in said body case.

14. An image formation device as claimed in claim 13, wherein said printer engine contains a process cartridge housing and at least one of a charging device, development device and cleaning device, and a photoconductor, formed integrally, and is mounted detachably to said body case.

* * * * *

UNITED STATES PATENT AND TRADEMARK OFFICE

CERTIFICATE OF CORRECTION

PATENT NO. : 7,413,188 B2
APPLICATION NO. : 11/069953
DATED : August 19, 2008
INVENTOR(S) : Miki It is certified that error appears in the above-identified patent and that said Letters Patent is hereby corrected as shown below:

On the title page, the Terminal Disclaimer information has been omitted. Item (45) and the Notice information should read:

Title page, items

-- (45) Date of Patent: * Aug. 19, 2008

(*) Notice: Subject to any disclaimer, the term of this patent is extended or adjusted under 35 U.S.C. 154(b) by 420 days.

This patent is subject to a terminal disclaimer. --

Signed and Sealed this

Seventh Day of October, 2008

JON W. DUDAS
*Director of the United States Patent and Trademark Office*